US006893104B2

(12) United States Patent
Tamura

(10) Patent No.: US 6,893,104 B2
(45) Date of Patent: May 17, 2005

(54) HEAD DRIVING DEVICE OF LIQUID EJECTING APPARATUS AND METHOD OF DISCHARGING CHARGE ON CHARGE ELEMENT THEREOF

(75) Inventor: Noboru Tamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 49 days.

(21) Appl. No.: 10/651,079

(22) Filed: Aug. 29, 2003

(65) Prior Publication Data

US 2004/0113959 A1 Jun. 17, 2004

(30) Foreign Application Priority Data

Aug. 30, 2002 (JP) ..... 2002-256186

(51) Int. Cl.[7] ..... B41J 29/38; B41J 2/045
(52) U.S. Cl. ..... 347/12; 347/68
(58) Field of Search ..... 347/5, 12, 13, 347/68–72

(56) References Cited

FOREIGN PATENT DOCUMENTS

JP 2002-264325 A 9/2002

*Primary Examiner*—Michael S. Brooke
(74) *Attorney, Agent, or Firm*—Sughrue Mion, PLLC

(57) ABSTRACT

A head driving device includes a liquid ejecting head formed with a nozzle orifice from which a liquid droplet is ejected, a driving signal generator generating a driving signal, a pressure generating element applying pressure to liquid based on the driving signal for ejecting the liquid droplet, a charge element charged at a reference voltage lower than a drive voltage for driving the pressure generating element, and applying a bias voltage to the pressure generating element, and a discharge circuit discharging a charge on the charge element to a ground when a voltage of the charge on the charge element is equal to or higher than a first voltage which is higher than the bias voltage.

10 Claims, 6 Drawing Sheets

HEAD DRIVING DEVICE OF LIQUID EJECTING APPARATUS AND METHOD OF DISCHARGING CHARGE ON CHARGE ELEMENT THEREOF

BACKGROUND OF THE INVENTION

The present invention relates to a head driving technique for a liquid ejecting apparatus, whereby the voltage of a charge on a charge element is employed to maintain a predetermined bias potential, on the ground terminal side of a pressure generating element, corresponding to a nozzle provided in the head of the liquid ejecting apparatus for ejecting liquid droplets, and whereby, due to the deterioration of the pressure generating element, the elevation of the voltage of the charge on the charge element is prevented.

The liquid ejecting device is used as a record apparatus used with an image record apparatus, a color material ejecting apparatus used for manufacturing a color filter of a liquid crystal display, etc., an electrode material (conductive paste) ejecting apparatus used for electrode formation of an organic EL display, an FED (face light emitting display), etc., a bioorganic substance ejecting apparatus used for biochip manufacturing, a specimen ejecting apparatus as a precision pipet, etc. One form of liquid ejecting device will be discussed by taking an ink jet printer as an example.

Ink jet color printers, used for the ejection from recording heads of several colors of ink, have become popular as output apparatuses for computers, and have been employed for the printing, using multiple colors and tones, of images processed by the computers.

For example, in an ink jet printer using a plurality of piezoelectric elements as driving elements, the piezoelectric elements corresponding a plurality of nozzles of a print head, are selectively driven, and ink droplets are ejected from the nozzles in accordance with the drive voltages applied to the individual piezoelectric elements, thereby the ink droplets are deposited as dots on a printing sheet for printing.

The piezoelectric elements are corresponded to the nozzles for ejecting ink droplets. The ink droplets are ejected based on drive signals supplied by a driver IC (drive wave generator) mounted in the print head.

This type of head driving device is shown in FIG. 5.

In FIG. 5, a head driving device 1 includes piezoelectric elements 2, each of which is corresponded to each of a plurality of nozzles of an ink jet printer; a drive waveform generating circuit 3 for supplying a drive signal to electrodes 2*a* of each piezoelectric element 2; and current amplifier circuits 4 and switch circuits 5, which are located between the drive waveform generating circuit 3 and each piezoelectric element 2.

While only one piezoelectric element 2 is shown in FIG. 5, since a plurality of nozzles are provided on the head of an ink jet printer, a plurality of piezoelectric elements are provided, one for each of the nozzles.

A drive signal COM, produced by the drive waveform generating circuit 3, is sequentially output, through a shift register, to each of the piezoelectric elements 2.

The piezoelectric elements 2 are provide so as to displace by voltages applied to electrodes 2*a* and 2*b*.

The piezoelectric elements 2*a* is charged at a level near the intermediate potential (a specific potential between the ground level (GND) and the power source level). And when a discharge is initiated based on the drive signal COM, which has a predetermined voltage waveform and which is supplied by the drive waveform generating circuit 3, ink droplets are ejected by applying pressure on the ink supplied for corresponding nozzles.

The drive waveform generating circuit 3 generates the drive signal COM that is transmitted to the head of the ink jet printer. The drive waveform generating circuit 3 may be located in either the printer main body or the printer head.

The current amplifier circuit 4 includes two drive devices, i.e., first and second transistors 4 and 4*b*.

For the first transistor 4*a*, the collector is connected to a constant voltage power source, the base is connected to a first output terminal of the drive waveform generating circuit 3, and the emitter is connected to the input terminal of the switch circuit 5. With this arrangement, upon the reception of the drive signal COM from the drive waveform generating circuit 3, the first transistor 4*a* is rendered active and transmits a charge from the constant voltage power source, with a predetermined voltage waveform, through the switching circuit 5 to the piezoelectric element 2.

For the second transistor 4*b*, the emitter is connected to the input terminal of the switching circuit 5, the base is connected to a second output terminal of the drive waveform generating circuit 3, and the collector is grounded. With this arrangement, upon the reception of a drive signal COM from the drive waveform generating circuit 3, the second transistor 4*b* discharges the piezoelectric element 2 through the switching circuit 5, with a predetermined voltage waveform.

Based on a control signal, the switching circuit 5 is turned on at the timing whereat a corresponding piezoelectric element 2 is driven, and outputs the drive signal COM to this piezoelectric element 2.

The switching circuit 5 is actually a so-called transmission gate that turns a corresponding piezoelectric element 2 on or off.

When the piezoelectric element 2 is inactive, i.e., when printing is not performed, a charge accumulated on the piezoelectric element 2 will be discharged, due to an insulating resistance, and the voltage dropped, so that ink ejection may be adversely affected.

To resolve this problem, a head driving device is also well known wherein a bias potential, such as the intermediate potential of the drive signal, is maintained on the grounded side of each piezoelectric element. This head driving device has the example configuration shown in FIG. 6.

In addition, there is a piezoelectric element the characteristic of which is improved because a bias potential is maintained, and when such a bias potential is maintained, the absolute value of the potential between the piezoelectric element terminals can be reduced to half at the maximum. Therefore, the withstand voltage of the piezoelectric element can be reduced.

In FIG. 6, a head driving device 6 has substantially the same configuration as the head driving device 1 in FIG. 5, except that a capacitor C1, to which a charge of about +5 V is applied, through a coupling resistor R1, by a constant voltage source Vc1. The capacitor C1 is connected to an electrode 2*b* of a piezoelectric element 2. The constant voltage source may also be employed as a logic power source.

The capacitor C1, which has a large capacitance, such as 3300 $\mu$F, is employed to supply a large current. The coupling resistor R1 is connected to the capacitor C1 to prevent the constant voltage source Vc1 from being adversely affected.

With this arrangement, the voltage of the electrode 2*b* of the piezoelectric element 2 is maintained at a bias voltage VBS by the voltage charged on the capacitor C1, and the voltage between the electrodes 2*a* and 2*b* of the piezoelectric element 2 is reduced. Thus, even when the density at which the piezoelectric elements are provided is high, a discharge between the electrodes of a piezoelectric element can be prevented, or the characteristic of the piezoelectric element can be improved.

However, for this head driving device 6, when deterioration of a piezoelectric element occurs over time, resistance between the terminals is reduced and a leakage current generated. When a leakage current from a constant voltage source Vcc flows through the piezoelectric element 2, this current is applied to and charges the capacitor C1, and also flows to the reference voltage side through the coupling resistor R1.

When the leakage current increases as deterioration of the piezoelectric element 2 advances, and when a leakage current of about 100 mA flows across the coupling resistor R1, at both ends of the coupling resistor R1 the voltage is only about 50 V because the coupling resistor R1 has a resistance of about 500 Ω. As a result, the initial objective, to maintain at the electrode 2*b* of each piezoelectric element 2 a voltage of about that supplied by Vc1, can not be achieved.

Whereas, since the capacitor C1 has a large capacitance, such as 3300 μF, a capacitor having as low a withstand voltage as possible, such as 6.3 V to 10 V, is employed because of the manufacturing cost.

Therefore, when a leakage current flows to the capacitor C1, a charging voltage that exceeds the withstand voltage will be used to charge the capacitor C1, and this may destroy the capacitor C1.

In order to prevent the damage of the capacitor C1 due to a leakage current from the piezoelectric element 2, recently, as is indicated by an arrow A in FIG. 6, an abnormal voltage detector (not shown) is employed to detect the voltage of the charge on the capacitor C1. When the voltage of the capacitor C1 charge rises until it is equal to or higher than a predetermined voltage, the head driving device 6 is powered off and the operation thereof is halted.

Thus the destruction of the capacitor C1 due to a leakage current from the piezoelectric element 2 can be prevented. However, according to this configuration, regardless of whether deterioration of the piezoelectric element 2 occurs, the head driving device 6 is powered off when a predetermined voltage is exceeded during the charging of the capacitor C1 by the leakage current. Therefore, the piezoelectric device 2 can not be fully utilized up to the expiration of its expected service life.

SUMMARY OF THE INVENTION

It is therefore an object of the present invention to provide a head driving device for a liquid ejecting device, having a simple configuration that discharges a charge element when the voltage of the charge on the charge element is raised due to a leakage current received from a pressure generating element, thereby preventing the destruction of the charge element and extending the use of the pressure generating element to the extent possible.

To achieve this objective, according to this invention, when the voltage of a charge on a charge element, which applies a predetermined bias voltage to the ground side electrode of a pressure generating element, reaches a predetermined voltage or higher, the charge element is discharged to prevent a further rise in the charge voltage of the charge element.

More specifically, according to the present invention, there is provided a head driving device of a liquid ejecting apparatus, comprising:

a liquid ejecting head, formed with a nozzle orifice from which a liquid droplet is ejected;

a driving signal generator, generating a driving signal;

a pressure generating element, applying pressure to liquid based on the driving signal for ejecting the liquid droplet;

a charge element, charged at a reference voltage lower than a drive voltage for driving the pressure generating element, and applying a bias voltage to the pressure generating element; and a discharge circuit, discharging a charge on the charge element to a ground when a voltage of the charge on the charge element is equal to or higher than a first voltage which is higher than the bias voltage.

According to this configuration, when a leakage current occurs, over time, due to the deterioration of a pressure generating element, the leakage current flows through the pressure generating element to a charge element. Then, when a charge has been placed on the charge element and a further charge has been placed on the charge element by this leakage current, and when the voltage of the charge held by the charge element has increased until the voltage is equal to or higher than the first voltage, the discharge circuit discharges the charge on the charge element to the ground.

As a result, since the voltage of the charge on the charge element is maintained substantially at the first voltage or lower, even when charging of the charge element by the leakage current has occurred, the voltage of the charge on the charge element will not rise until that voltage is equal to or higher than the withstand voltage, and the charge element will not be destroyed.

Therefore, since a rise in the voltage of the charge on the charge element due to the leakage current need not be taken into account, a charge element having a withstand voltage slightly higher than the bias voltage can be employed, and the manufacturing cost is not increased.

As is described above, according to the head driving device of the liquid ejecting apparatus, even when a bias voltage, such as the intermediate potential, is applied by a charge element to the pressure generating element, and even when a leakage current occurs due to the deterioration of the pressure generating element over time, a rise in the voltage of the charge on the charge element due to the leakage current can be suppressed, and the destruction of the charge element can be prevented.

Preferably, the discharge circuit includes a switching element connected between the charge element and the ground. The switching element is turned on when the voltage of the charge on the charge element is equal to or higher than the first voltage.

With this configuration, when the voltage of a charge on a charge element rises to the predetermined voltage or higher, the switching element is turned on, grounding and short-circuiting the charge element through the switching circuit and discharging the charge element.

Here, it is preferable that, the switching element includes a transistor, the base of which is connected to a reference voltage source, the emitter of which is connected to the charge element and the collector of which is grounded.

With this arrangement, when the voltage of the charge on the charge element rises to the first voltage or higher, the emitter and the collector of the transistor are rendered active, grounding and short-circuiting the charge element through the transistor, and discharging the charge element.

Here, it is preferable that, a current limiter resistor is connected in series between the collector of the charge element and the ground.

With this arrangement, when the transistor is rendered active, the charge on the charge element is transmitted through the transistor and the current limiter resistor to the ground, so that the discharge current for the charge element is limited by the current limiter resistor.

Therefore, when the pressure generating element is short-circuited and a large current flows through the pressure generating element to the charge element and causes the voltage of the charge on the charge element to increase drastically, the discharge current is suppressed by the current limiter resistor. Thus, a large discharge current from the charge element does not flow through the transistor, and the transistor is protected.

Preferably, the head driving device further comprises an abnormal voltage detector, outputting a detection signal when the voltage of the charge on the charge element reaches a second voltage higher than the first voltage.

With this configuration, when, as is described above, the pressure generating element is short-circuited and a large current flows through the pressure generating element to the charge element and causes the voltage of the charge on the charge element to increase rapidly, and when the discharge current of the charge element is suppressed by the current limiter resistor and the voltage of the charge on the charge element rises and exceeds the second predetermined voltage, the abnormal voltage detector detects this phenomenon and outputs a detection signal.

Upon receiving the detection signal from the abnormal voltage detector, the controller of the liquid ejecting main body reduces the drive voltage of the head driving device. Therefore, when a short-circuit has occurred because of the destruction of the pressure generating element, the destruction of the head driving device can be prevented.

Or, upon receiving the detection signal from the abnormal voltage detector of the head driving device, the controller of the liquid ejecting main body can control the head driving device and temporarily halt the ejecting operation, or can forcibly terminate the liquid ejecting operation. Therefore, the liquid ejecting head can be protected from the abnormal current output by the pressure generating element.

Here, it is preferable that, the transistor is a FET.

According to this arrangement, since the transistor serving as the switching element is a FET, the transistor in the controller of the liquid ejecting main body can be integrally formed with circuit elements that constitute other logic circuits. Thus, the manufacturing cost can be reduced.

Preferably, the pressure generating element is a piezoelectric element.

Preferably, the charge element is a capacitor.

According to the present invention, there is also provided a method of discharging a charge on a charge element of a head driving device of a liquid ejecting head, comprising the steps of:

ejecting a liquid droplets based on a driving signal by applying pressure to liquid;

charging a charge element at a reference voltage lower than a drive voltage for ejecting the liquid droplet;

applying a bias voltage to a pressure generating element by the charge on the charge element; and discharging the charge on the charge element to a ground when a voltage of the charge on the charge element is equal to or higher than a first voltage which is higher than the bias voltage.

Preferably, the method further comprises the steps of:

detecting whether the voltage of the charge on the charge element reaches a second voltage higher than the first voltage; and outputting a detection signal based on a result of the detecting step.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A head driving device according to one embodiment of the present invention will now be described while referring to the accompanying drawings.

It should be noted that the following embodiment is one preferred example for the invention, and that various preferable technical limits are provided. However, the invention is not limited to these modes unless specific limitations are included in the following explanation.

Figure 1:
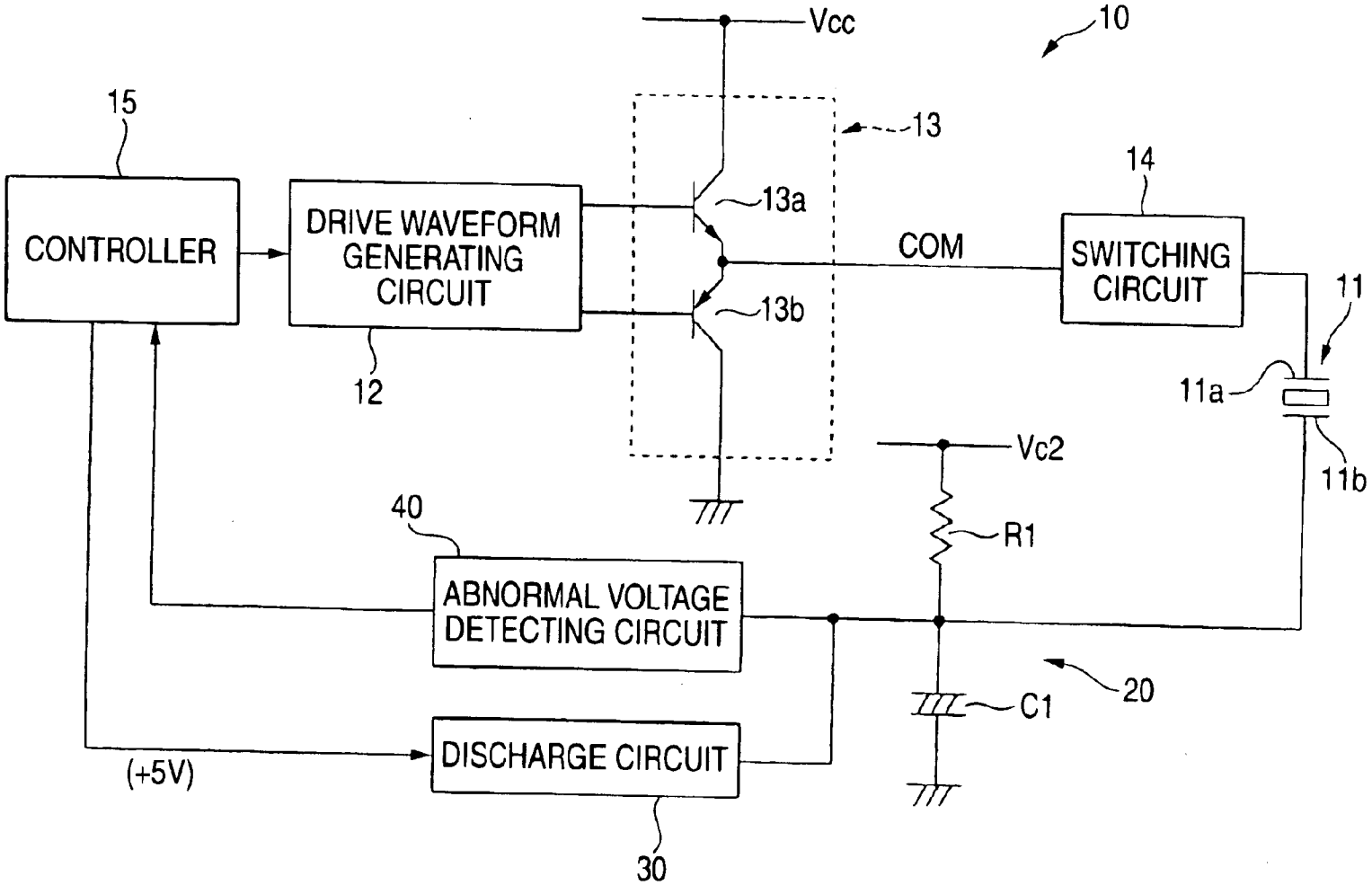
FIG. 1 is a block diagram showing the configuration of a head driving device according to one embodiment of the present invention.

FIG. 1 is a diagram showing the configuration of a head driving device according to the embodiment of the invention.

In FIG. 1, a head driving device 10 includes a plurality of piezoelectric elements 11, a drive waveform generating circuit 12, current amplifier circuits 13, nozzle selection switching circuits 14, a bias voltage supply circuit 20, a discharge circuit 30, and an abnormal voltage detecting circuit 40. The piezoelectric elements 11 are provided for corresponding nozzles in the printer head of an ink jet printer. The drive waveform generating circuit 12 supplies a drive signal COM to an electrode 11*a* of each piezoelectric element 11. The current amplifier circuits 13 and the nozzle selection switching circuits 14 are arranged between the drive waveform generating circuit 12 and the piezoelectric elements 11. The bias voltage supply circuit 20 applies a predetermined bias voltage to ground side electrodes 11*b* of the piezoelectric elements 11.

In FIG. 1, actually, one nozzle row for each color is provided on the printer head of the ink jet printer, and the piezoelectric elements 11 are provided for these nozzle rows respectively.

The piezoelectric elements 11 are displaced by the voltage applied to the electrodes 11*a* and 11*b*.

The piezoelectric elements 11, are charged at near the intermediate potential Vc in const. When a charge or a discharge is initiated based on the drive signal COM having a predetermined voltage waveform from the drive waveform generating circuit 12, ink droplets are ejected by applying pressure on the ink in nozzles.

The drive waveform generating circuit 12 generates the drive signal COM to be transmitted to the printer head of the ink jet printer. The drive waveform generating circuit 12 is located in a controller 15 within the printer main body or the printer head.

Each of the current amplifier circuits 13 includes first and second transistors 13*a* and 13*b*.

The collector of the first transistor 13*a* is connected to a constant-voltage source Vcc, such as a +42 V current source, the base is connected to a first output terminal of the drive waveform generating circuit 12, and the emitter is connected to the input terminal of the switching circuit 14. With this structure, the first transistor 13*a* is rendered conductive, based on the drive signal COM received from the drive waveform generating circuit 12, and supplies charges from the constant-voltage source Vcc, through the switching circuit 14, to the corresponding piezoelectric element 11 with a predetermined voltage waveform.

The emitter of the second transistor 13*b* is connected to the input terminal of the switching circuit 14, the base is connected to a second output terminal of the drive waveform generating circuit 12, and the collector is grounded. With this structure, the second transistor 13*b* is rendered conductive, based on the drive signal COM received from the drive waveform generating circuit 12, and discharges the corresponding piezoelectric element 11 through the switching circuit 14 with a predetermined voltage waveform.

When the switching circuits 14 receive a control signal from the controller 15 in the printer main body, the switching circuits 14 are turned on at the drive timings for the corresponding piezoelectric elements 11, and output the drive signal COM to the piezoelectric elements 11.

The switching circuits 14 are actually so-called transmission gates for turning on or off the piezoelectric elements 11.

Figure 2:
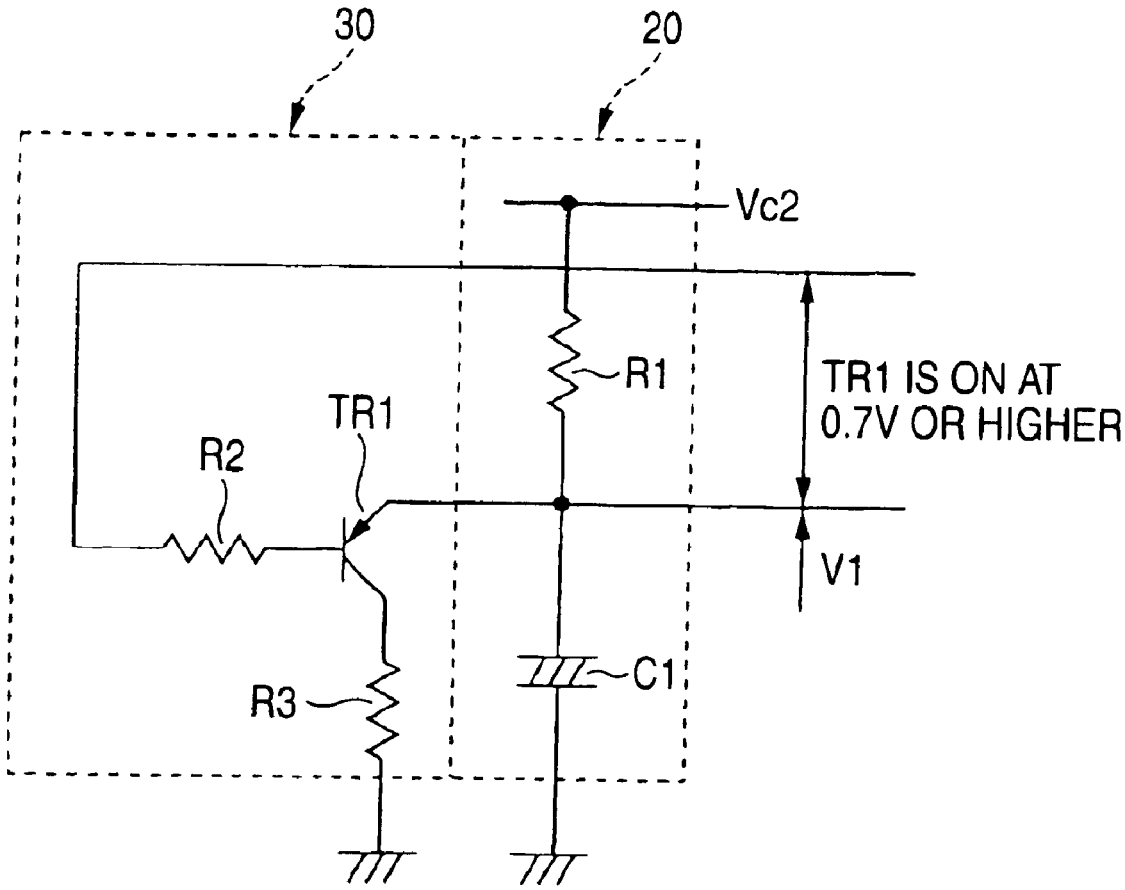
FIG. 2 is a circuit diagram showing an arrangement for a bias voltage supply circuit and a discharge circuit for the head driving device in FIG. 1.

The bias voltage supply circuit 20 includes a capacitor C1, as is shown in FIG. 2.

The capacitor C1 is an electrolytic capacitor, one terminal of which is grounded while the other is connected to the ground side electrodes 11*b* of the piezoelectric elements 11 so that a charge voltage of the capacitor C1, i.e., a bias voltage VBS, is applied to the electrodes 11*b* of the piezoelectric elements 11.

Furthermore, a capacity of the capacitor C1 is determined at several thousand $\mu$F, such as one of around 3300 $\mu$F which satisfies a large capacity relative to the total electrostatic capacitance for all the piezoelectric elements 11 of several $\mu$F, about 1.4 $\mu$F, for example, so that the bias voltage VBS can be stably supplied to the piezoelectric elements 11.

Further, one end of the capacitor C1 is connected to a second constant-voltage source through a coupling resistor R1 (e.g., 500 Ω).

The second constant-voltage source is a current source of +5 V that serves as a logic power source for the controller 15 in the printer main body, and that charges the capacitor C1 by applying a constant voltage Vc2 to the capacitor C1 through the coupling resistor R1.

In this manner, the bias voltage supply circuit 20 outputs, to the ground-side electrodes 11*b* of the piezoelectric elements 11, a predetermined bias voltage VBS that preferably is substantially equal to the intermediate potential Vc of the drive signal COM transmitted by the drive waveform generating circuit 12.

As is shown in FIG. 2, the discharge circuit 30 includes a transistor TR1, which serves as a switching element, the base of which is connected through a current limiter resistor R2 to a constant-voltage source Vc2 for a reference voltage, the emitter of which is connected to the capacitor C1, and the collector of which is grounded through a current limiter resistor R3.

The current limiter resistor R3 limits the current flowing across the transistor TR1, and an appropriate resistance, one of about 100 Ω, is selected for the current limiter resistor R3, so that the voltage for the capacitor C1 charge is raised when a leakage current from the corresponding piezoelectric element 2 is increased.

The current limiter resistor R2 prevents the flow of a large current from the emitter of the transistor TR1 to the base when the current flowing across the transistor TR1 is limited by the current limiter resistor R3. The resistance of the current limiter resistor R2 is set to about 1 KΩ.

With this arrangement of the discharge circuit 30, when the voltage of the capacitor C1 charge has a predetermined voltage difference, such as 0.7 V, from the constant voltage Vc2, i.e., when the voltage of the capacitor C1 charge reaches a predetermined voltage V1 (=5.0 V+0.7 V), the emitter-collector interval of the transistor TR1 is rendered conductive and the capacitor C1 is discharged to the ground.

Figure 3:
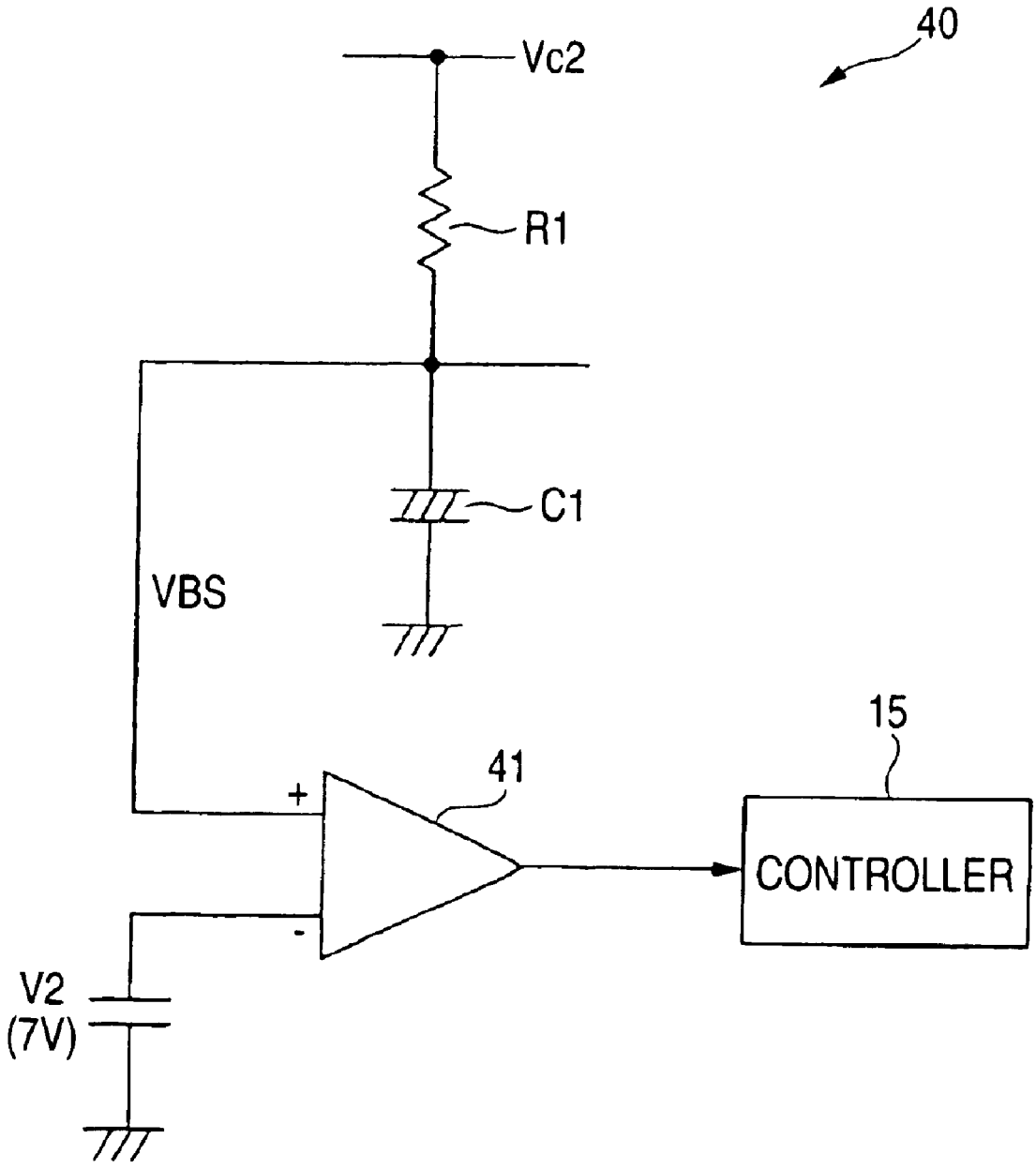
FIG. 3 is a circuit diagram showing an example abnormal voltage detector arrangement for the head driving device in FIG. 1.

As is shown in FIG. 3, the abnormal voltage detecting circuit 40 includes a comparator 41 wherein the bias voltage VBS is supplied to the noninverting input terminal, and a second predetermined voltage V2, such as 7 V, is supplied to the inverting input terminal, and an output signal of the abnormal voltage detecting circuit 40 is transmitted to the controller 15 in the printer main body.

Since the bias voltage is usually about 5 V, the output signal of the comparator 41 is at level L; however, when the bias voltage VBS rises to the second predetermined voltage V2, or higher, due to an abnormal current in the piezoelectric element 11, the output signal of the comparator 41 is inverted to level H.

When the output signal of the comparator 41 of the abnormal voltage detecting circuit 40 is inverted to level H, the controller 15 of the printer main body assumes that an abnormality has occurred in the piezoelectric element 11. Then, the controller 15 drops the drive voltage of the head driving device 10, so that the head driving device 10 can be protected from being destroyed due to a short circuit that is caused by the destruction of the piezoelectric element 11, or permits the head driving device 10 to temporarily halt or to forcibly terminate the printing operation to protect the printer head from being destroyed due to the abnormal current in the piezoelectric element 11.

The thus arranged head driving device 10 of the embodiment performs the following operation.

First, when power is on and the drive signal COM is output by the drive waveform generating circuit 12, the first transistors 13*a* of the current amplifier circuits 13 are turned on, and the first constant-voltage source supplies a current to the electrodes 11*a* of the piezoelectric elements 11 through the switching circuits 14. Then, through this charging, the electrodes 11*a* of the piezoelectric elements 11 are gradually raised to the intermediate potential Vc.

In the bias voltage supply circuit 20, the capacitor C1 is charged by the second constant-voltage source Vc2, and the charge on the capacitor is then applied to the ground side electrodes 11*b* of the piezoelectric elements 11 as the bias voltage VBS, so that the voltage at the electrodes 11*b* equals the bias voltage VBS.

Therefore, the potential difference between the electrodes 11*a* and 11*b* of the piezoelectric elements 11 is substantially 0.

The operation performed while the power is on is completed.

When printing is initiated, the drive signal COM is output by the drive waveform generating circuit 12. The piezoelectric elements 11 are charged or discharged based on a change in the drive signal COM so that ink droplets are ejected.

At this time, the ground side electrodes 11*b* of the piezoelectric are maintained at the bias voltage VBS by the application of the bias voltage VBS by the bias voltage supply circuit 20.

Therefore, in the discharge circuit 30, the emitter voltage of the transistor TR1 is maintained at the bias voltage VBS, substantially equal to the constant voltage Vc2 of the second constant-voltage source, and the constant voltage Vc2 of the second constant-voltage source is applied to the base. Therefore, since the base voltage and the emitter voltage are almost equal, the transistor TR1 is nonconductive.

Thus, the discharge of the capacitor C1 through the transistor TR1 does not occur.

On the other hand, when the inter-electrode resistance is reduced due to the deterioration, over time, of the piezoelectric elements 11, and a leakage current has occurred between the electrodes 11*a* and 11*b,* the leakage current enters the capacitor C1 of the bias voltage supply circuit 20 through the piezoelectric elements 11 in a case that the drive signal COM is higher than the intermediate potential Vc. As a result, the capacitor C1 is charged at a voltage which is higher than the constant voltage Vc2 of the second constant-voltage source.

When the voltage of the capacitor C1 charge exceeds a predetermined voltage V1, the emitter voltage for the transistor TR1 of the discharge circuit 30 becomes higher than the base voltage, so that the emitter-collector interval for the transistor TR1 is rendered conductive. Then, the capacitor C1 charge is transmitted to the ground through the transistor TR1 and the current limiter resistor R3, i.e., the capacitor C1 is discharged.

Therefore, even when a leakage current has occurred in the piezoelectric elements 11, the voltage of the capacitor C1 charge is prevented from rising, due to the leakage current, until it is higher than the predetermined voltage V1, and the abnormal voltage detecting circuit 40 is not activated.

When the amount of the leakage current is increased because the piezoelectric elements 11 deteriorate further as time elapses, or when an abnormality, such as a short circuit or a layer short circuit (partially short circuit), has occurred at the piezoelectric elements 11, a large leakage current or a large short-circuit current is output by the constant-voltage source Vcc and enters the capacitor C1 through the piezoelectric elements 11.

When the voltage of the capacitor C1 charge is raised, the transistor TR1 in the discharge circuit 30 is rendered on, and the capacitor C1 is discharged. At this time, since the discharge current is limited by the current limiter resistor R3, the voltage of the capacitor C1 charge is further increased.

When as a result the voltage of the capacitor C1 charge exceeds 7 V, the comparator 41 of the abnormal voltage detecting circuit 40 is inverted and its output signal goes to level H.

Therefore, based on the output signal at level H, the controller 15 in the printer main body drops the drive voltage of the head driving device 10, and prevents the head driving device 10 from being destroyed due to a short circuit caused by the destruction of the piezoelectric elements 11.

As is described above, since the voltage of the capacitor C1 charge is increased when a large leakage current or an abnormal current has occurred in the piezoelectric elements 11, the abnormal voltage detecting circuit 40 detects this increase and outputs a signal at level H to notify the controller 15 in the printer main body of this phenomenon. Therefore, when a large current occurs due to the deterioration, over time, of the piezoelectric elements 11, or when an abnormal current occurs due to a short circuit in the piezoelectric elements 11, the controller 15 in the printer main body controls the head driving device 10 based on a level H signal received from the abnormal voltage detecting circuit 40. As a result, the piezoelectric elements 11, the printer head and the head driving device 10 can be protected from being destroyed and can be maintained safely.

In this embodiment, the discharge circuit 40 includes the transistor TR1. However, the transistor TR1 may be an FET, and in this case, since the discharge circuit 30 can be integrally formed with an IC that constitutes the controller 15 of the printer main body, the manufacturing cost can be reduced.

It is further apparent that the discharge circuit 30 may also be constituted by another switching element that enables the discharge of the capacitor C1.

Furthermore, in this embodiment, for the discharge circuit 30, the current limiter resistor R3 is arranged between the collector of the transistor TR1 and the ground. However, the current limiter resistor R3 may not be provided. In this case, when the voltage of the capacitor C1 becomes equal to or higher than the predetermined voltage V1, the discharge of the capacitor C1 will be initiated. Therefore, even when an abnormal current flows across the piezoelectric elements 11, the voltage of the capacitor C1 charge can be maintained at the predetermined voltage V1 or lower, and the destruction of the capacitor C1 can be prevented.

In this embodiment, the bias voltage supply circuit 20 outputs the bias voltage VBS, which is substantially equal to the intermediate voltage Vc of the drive signal COM transmitted by the drive waveform generating circuit 12. However, the bias voltage supply circuit 20 may output a bias voltage VBS that is shifted away from the intermediate voltage Vc.

In this case, the voltage applied between the electrodes 11*a* and 11*b* of the piezoelectric elements 11 does not approach zero. However, since the potential difference is smaller than when no bias voltage is applied, the voltage drop due to the natural discharge from the piezoelectric element is reduced, and accordingly, the power loss can be reduced.

In addition, in this embodiment, the abnormal voltage detecting circuit 40 outputs a signal at level L under normal conditions, and outputs a signal at level H when an abnormality occurs in the piezoelectric element 11. However, the abnormal voltage detecting circuit 40 may output a signal at level H under normal conditions, and may output a signal at level L when an abnormality occurs in the piezoelectric element 11.

Further, in this embodiment, the abnormal voltage detecting circuit 40 includes the comparator 41, for detecting a rise in the voltage of the capacitor C1 charge. However, the configuration shown in FIG. 4 may also be employed.

Figure 4:
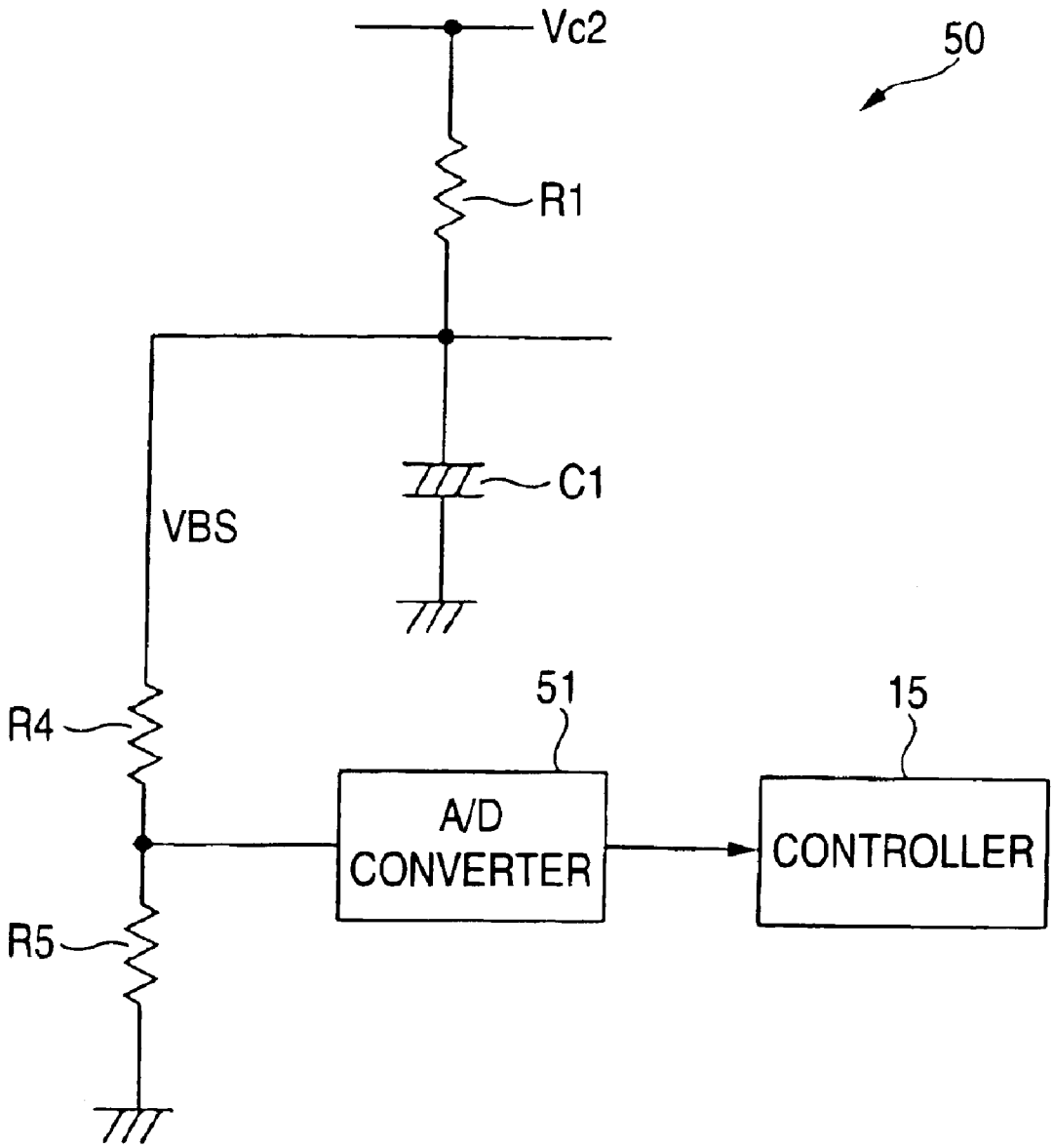
FIG. 4 is a circuit diagram showing another example abnormal voltage detector arrangement for the head driving device in FIG. 1.
Figure 5:
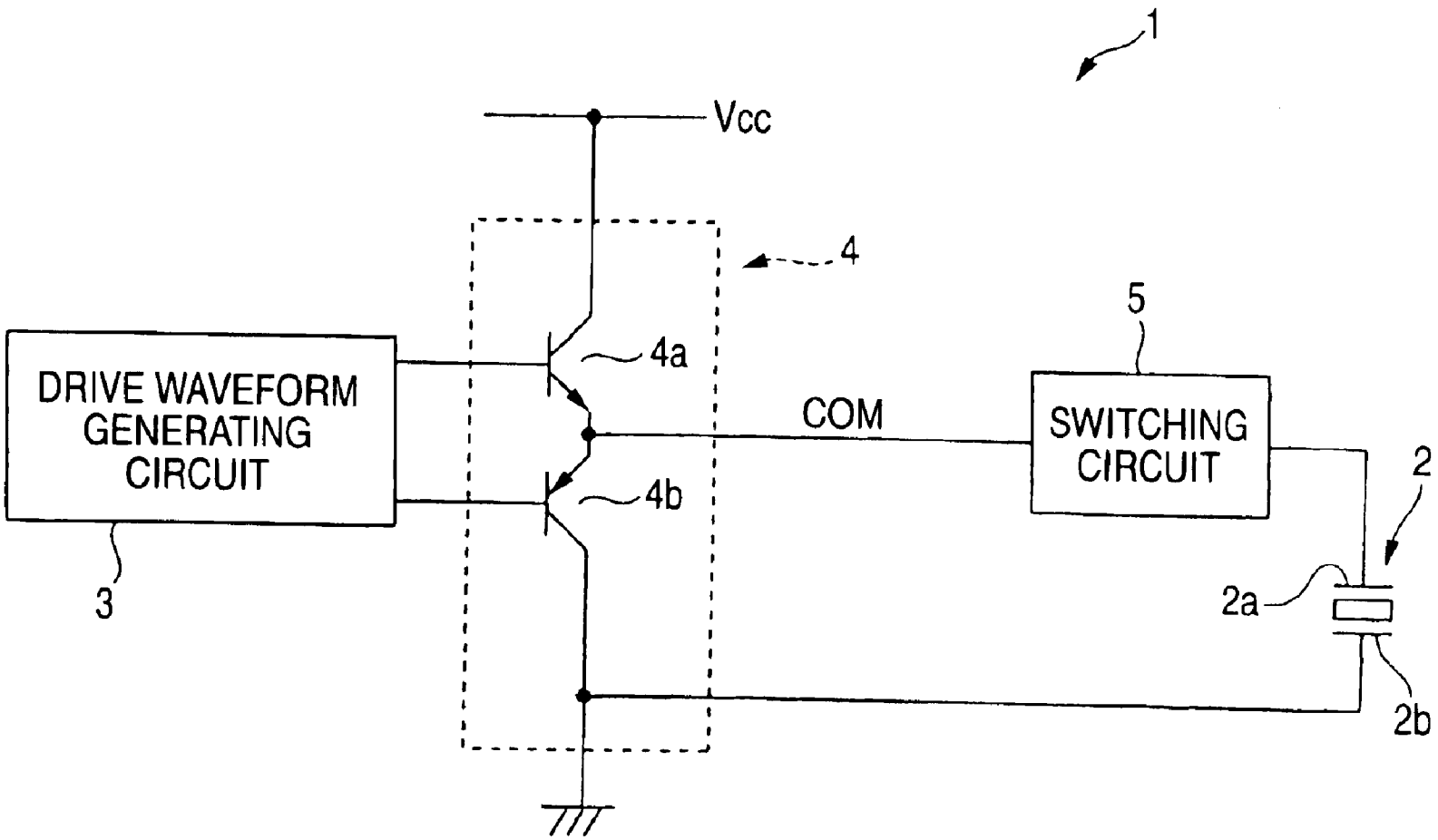
FIG. 5 is a block diagram showing an example configuration for a related head driving device.
Figure 6:
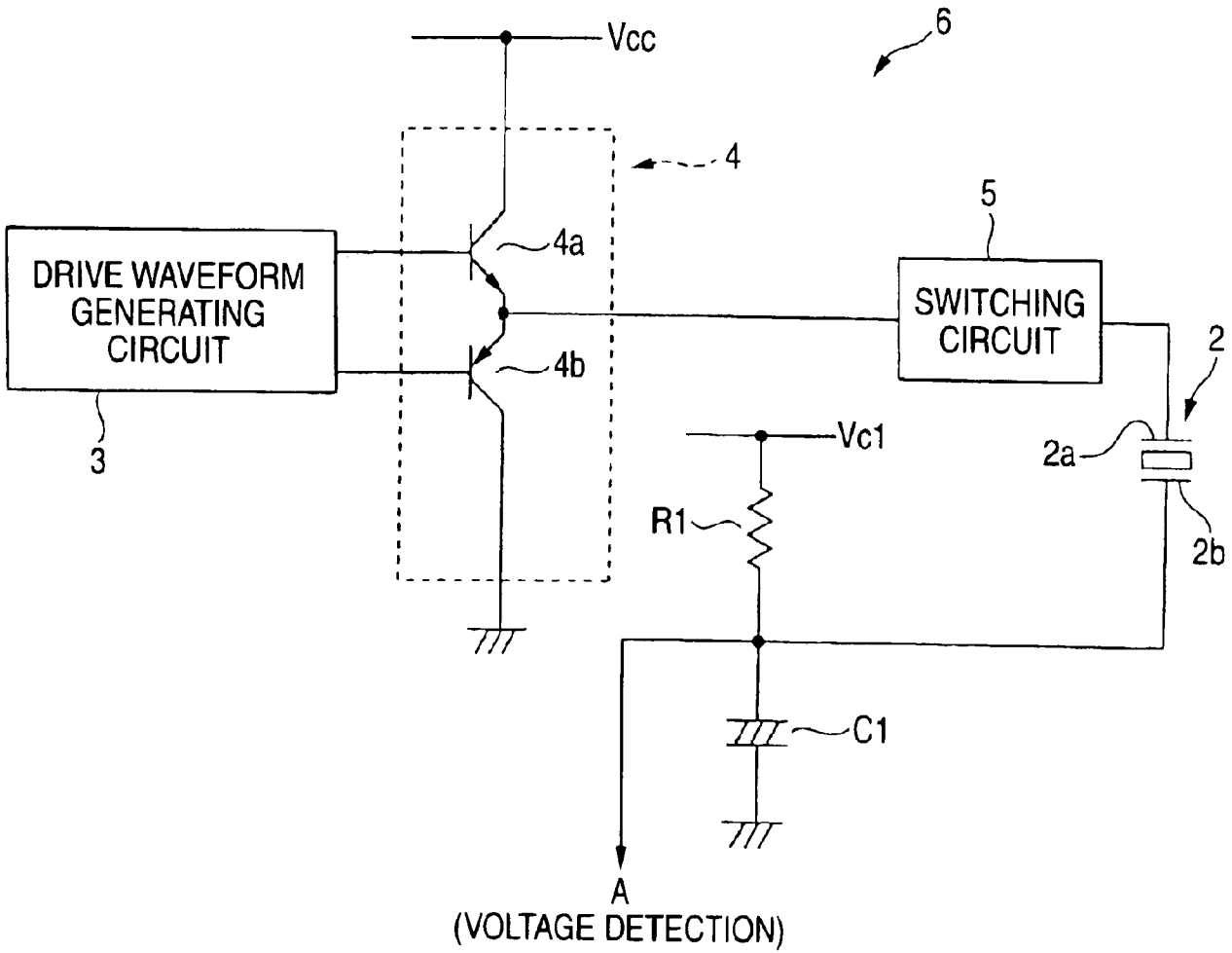
FIG. 6 is a block diagram showing an example arrangement for a related head circuit that includes a bias voltage supply circuit.

Specifically, in FIG. 4, an abnormal voltage detecting circuit 50 includes voltage divider resistors R4 and R5 and an AD converter 51. The voltage divider resistors R4 and R5 are connected in series for the voltage of the capacitor C1 charge, i.e., the bias voltage VBS. The AD converter 51 receives the divided voltage from the voltage divider resistors R4 and R5. When the controller 15 in the printer main body obtains a reading for the A/D converter 51 indicating that the bias voltage VBS exceeds a specific voltage, such as 7 V, the controller 15 controls the head driving device 10, as previously described in the above embodiment.

In this case, the A/D converter 51 may be included in an IC constituting the controller 15.

Furthermore, in this embodiment, the abnormal voltage detecting circuit 40 or 50 is provided, however, a detector of this type is not always required. In such a case, another, arbitrary member may be employed to detect an abnormality in the piezoelectric element 11, and based on the detection results, the controller 15 in the printer main body may provide appropriate control for the head driving device 10.

What is claimed is:

1. A head driving device of a liquid ejecting apparatus, comprising:

a liquid ejecting head, formed with a nozzle orifice from which a liquid droplet is ejected;

a driving signal generator, generating a driving signal;

a pressure generating element, applying pressure to liquid based on the driving signal for ejecting the liquid droplet;

a charge element, charged at a reference voltage lower than a drive voltage for driving the pressure generating element, and applying a bias voltage to the pressure generating element; and a discharge circuit, discharging a charge on the charge element to a ground when a voltage of the charge on the charge element is equal to or higher than a first voltage which is higher than the bias voltage.

2. The head driving device as set forth in claim 1, wherein the discharge circuit includes a switching element connected between the charge element and the ground; and wherein the switching element is turned on when the voltage of the charge on the charge element is equal to or higher than the first voltage.

3. The head driving device as set forth in claim 2, wherein the switching element includes a transistor, the base of which is connected to a reference voltage source, the emitter of which is connected to the charge element and the collector of which is grounded.

4. The head driving device as set forth in claim 3, wherein a current limiter resistor is connected in series between the collector of the charge element and the ground.

5. The head driving device as set forth in claim 1, further comprising an abnormal voltage detector, outputting a detection signal when the voltage of the charge on the charge element reaches a second voltage higher than the first voltage.

6. The head driving device as set forth in claim 3, wherein the transistor is a FET.

7. The head driving device as set forth in claim 1, wherein the pressure generating element is a piezoelectric element.

8. The head driving device as set forth in claim 1, wherein the charge element is a capacitor.

9. A method of discharging a charge on a charge element of a head driving device of a liquid ejecting head, comprising the steps of:

ejecting a liquid droplets based on a driving signal by applying pressure to liquid;

charging a charge element at a reference voltage lower than a drive voltage for ejecting the liquid droplet;

applying a bias voltage to a pressure generating element by the charge on the charge element; and discharging the charge on the charge element to a ground when a voltage of the charge on the charge element is equal to or higher than a first voltage which is higher than the bias voltage.

10. The method as set forth in claim 9, further comprising the steps of:

detecting whether the voltage of the charge on the charge element reaches a second voltage higher than the first voltage; and outputting a detection signal based on a result of the detecting step.

* * * * *